US010601110B2

(12) United States Patent
Andujar Linares et al.

(10) Patent No.: US 10,601,110 B2
(45) Date of Patent: Mar. 24, 2020

(54) WIRELESS DEVICE AND ANTENNA SYSTEM WITH EXTENDED BANDWIDTH

(71) Applicant: Fractus Antennas, S.L., Barcelona (ES)

(72) Inventors: Aurora Andujar Linares, Barcelona (ES); Jaume Anguera Pros, Vinaros (ES); Carles Puente Baliarda, Barcelona (ES)

(73) Assignee: Fractus Antennas, S.L., Barcelona (ES)

( * ) Notice: Subject to any disclaimer, the term of this patent is extended or adjusted under 35 U.S.C. 154(b) by 0 days.

(21) Appl. No.: 15/621,792

(22) Filed: Jun. 13, 2017

(65) Prior Publication Data

US 2017/0358848 A1 Dec. 14, 2017

Related U.S. Application Data

(60) Provisional application No. 62/349,124, filed on Jun. 13, 2016.

(51) Int. Cl.
*H01Q 1/24* (2006.01)
*H01Q 1/36* (2006.01)
(Continued)

(52) U.S. Cl.
CPC ..... *H01Q 1/243* (2013.01); *H01Q 1/36* (2013.01); *H01Q 5/335* (2015.01); *H01Q 5/371* (2015.01);
(Continued)

(58) Field of Classification Search
CPC ..... H01Q 1/24; H01Q 1/243; H01Q 1/36; H01Q 5/335; H01Q 5/371; H01Q 5/40; H01Q 9/0421
See application file for complete search history.

(56) References Cited

U.S. PATENT DOCUMENTS 7,274,340 B2 9/2007 Ozden et al.
7,688,276 B2 3/2010 Quintero Illera et al.
(Continued)

FOREIGN PATENT DOCUMENTS

EP 2978069 A1 1/2016
EP 3073568 A1 9/2016
(Continued)

OTHER PUBLICATIONS

Ilvonen, J, et al., "Design Strategy for 4G Handset Antennas and a Multiband Hybrid Antenna," IEEE Transactions on Antennas and Propagation, vol. 62(4), pp. 1918-1927 (Apr. 2014).
(Continued)

*Primary Examiner* — Hoang V Nguyen
(74) *Attorney, Agent, or Firm* — Edell, Shapiro & Finnan, LLC

(57) ABSTRACT

A wireless device comprises a radiating structure that comprises a ground plane layer etched on a PCB, including a clearance area nearby one edge of the PCB, and an antenna element mounted on the clearance area. The radiating structure is included in a radiating system that also includes a radiofrequency system comprising at least a matching network, including more than three components. The radiofrequency system connects the antenna element to a feeding line connected at its end to an external port. The antenna element features a maximum length within the 22-30 mm range to match the radiating system in the multiple frequency bands of operation. In general, a radiating system features extended bandwidth, typically including LTE700 bands or below. The antenna element may include two conductive adjacent surfaces with a convex shape connected between them.

16 Claims, 3 Drawing Sheets

(51) Int. Cl.

| | |
|---|---|
| ***H01Q 5/371*** | (2015.01) |
| ***H01Q 5/40*** | (2015.01) |
| ***H01Q 9/04*** | (2006.01) |
| ***H01Q 5/335*** | (2015.01) |
| ***H01Q 9/42*** | (2006.01) |

(52) U.S. Cl.
CPC ..... *H01Q 5/40* (2015.01); *H01Q 9/0421* (2013.01); *H01Q 9/42* (2013.01)

(56) References Cited

U.S. PATENT DOCUMENTS

| | | | | |
|---|---|---|---|---|
| 8,456,365 | B2 | 6/2013 | Pros et al. | |
| 9,130,267 | B2 | 9/2015 | Anguera et al. | |
| 10,008,762 | B2 | 6/2018 | Andujar Linares et al. | |
| 10,062,973 | B2 | 8/2018 | Andujar Linares et al. | |
| 10,122,403 | B2 | 11/2018 | Anguera Pros et al. | |
| 10,236,561 | B2 | 3/2019 | Anguera Pros et al. | |
| 2008/0198082 | A1* | 8/2008 | Soler Castany ..... | H01Q 1/242 343/770 |
| 2011/0163922 | A1* | 7/2011 | Wang ..... | H01Q 1/243 343/702 |
| 2013/0342416 | A1* | 12/2013 | Andujar Linares ..... | H01Q 1/50 343/843 |
| 2014/0015728 | A1 | 1/2014 | Anguera Pros et al. | |
| 2014/0015730 | A1* | 1/2014 | Anguera Pros ..... | H01Q 1/243 343/860 |
| 2014/0253395 | A1 | 9/2014 | Puente Baliarda et al. | |
| 2016/0111790 | A1 | 4/2016 | Anguera Pros et al. | |
| 2017/0214137 | A1 | 7/2017 | Anguera Pros et al. | |

FOREIGN PATENT DOCUMENTS

| | | | |
|---|---|---|---|
| WO | 2006032455 | A1 | 3/2006 |
| WO | 2007039071 | A2 | 4/2007 |
| WO | 2007128340 | A1 | 11/2007 |
| WO | 2007141187 | A2 | 12/2007 |
| WO | 2008009391 | A1 | 1/2008 |
| WO | 2008119699 | A1 | 10/2008 |
| WO | 2010015364 | A2 | 2/2010 |
| WO | 2010015365 | A2 | 2/2010 |
| WO | 2010145825 | A1 | 12/2010 |
| WO | 2011095330 | A1 | 8/2011 |
| WO | 2014012796 | A1 | 1/2014 |
| WO | 2014012842 | A1 | 1/2014 |

OTHER PUBLICATIONS

Run mXTENDTM (FR01-S4-224)—AN for 2G/3G/4G Handsets 824-960 MHz and 1710-2690MHz: application notes, Nov. 2016, 7 p., Fractus Antennas S.L., Sant Cugat, Spain <http://www.fractusantennas.com>.

Cube mXTENDTM (FR01-S4-250)—A standard antenna solution for mobile frequency bands: user manual, Jun. 2017, 50 p., Fractus Antennas S.L., Sant Cugat, Spain <http://www.fractusantennas.com>.

Rhyu, H., et al., "Multi-band hybrid antenna for ultra-thin mobile phone applications", Electronics letters, Jul. 2009, pp. 773-775, vol. 45, No. 15.

Andujar, A., et al., "Ground Plane Boosters as a Compact Antenna Technology for Wireless Handheld Devices", IEE Transactions on Antennas and Propagation, May 2011, pp. 1668-1677, vol. 59, No. 5.

Andujar, A., Ground Plane Booster Antenna Technology for Wireless Handheld Devices, PhD Dissertation, May 2013, pp. 72-85,88-102,116-119,176-177,180-186, Barcelona—Spain, Department of Signal Theory and Communications, Universitat Politècnica de Catalunya, Technology and Intellectual Property Rights Department Fractus.

Samsung FCC ID: A3LSGHT989D Internal photographs, 2011 PCTEST Engineering Laboratory Inc.

Samsung FCC ID:A3LSGH1937 Internal photographs, 2011 PCTEST Engineering Laboratory Inc.

Samsung FCC ID: A3LSGHI997 Internal photographs, 2011 PCTEST Engineering Laboratory Inc.

Samsung FCC ID: A3LSGHT959V Internal photographs, 2011 PCTEST Engineering Laboratory Inc.

Samsung FCC ID: A3LSGHI727 Internal photographs, 2011 PCTEST Engineering Laboratory Inc.

Samsung FCC ID: A3LSGHI667 Internal photographs, 2012 PCTEST Engineering Laboratory Inc.

Samsung FCC ID: A3LSGHT499 Internal photographs, 2011 PCTEST Engineering Laboratory Inc.

Samsung FCC ID: A3LSGHI827 Internal photographs, 2012 PCTEST Engineering Laboratory Inc.

Samsung FCC ID: A3LSGHA927 Internal photographs, 2010 PCTEST Engineering Laboratory Inc.

* cited by examiner

WIRELESS DEVICE AND ANTENNA SYSTEM WITH EXTENDED BANDWIDTH

CROSS REFERENCE TO RELATED APPLICATIONS

This application claims priority under 35 U.S.C. § 119(e) from U.S. Provisional Patent Application Ser. No. 62/349,124, filed Jun. 13, 2016, the entire contents of which are hereby incorporated by reference.

TECHNICAL FIELD

The present disclosure relates to the field of wireless portable devices, and more specifically to wireless handheld devices that require large bandwidths.

BACKGROUND

Wireless electronic devices typically handle one or more cellular communication standards, and/or wireless connectivity standards, and/or broadcast standards, each standard being allocated in one or more frequency bands, and the frequency bands being contained within one or more regions of the electromagnetic spectrum.

For that purpose, a typical wireless electronic device must include a radiating system capable of operating in one or more frequency regions with an acceptable radio-electric performance (in terms of, for instance, reflection coefficient, standing wave ratio, impedance bandwidth, gain, efficiency, or radiation pattern). The integration of the radiating system within the wireless electronic device must be effective to ensure that the overall device attains good radio-electric performance (such as for example in terms of radiated power, received power, sensitivity) without being disrupted by electronic components and/or human loading.

The space within the wireless electronic device is usually limited and the radiating system has to be included in the available space. The radiating system is expected to be small to occupy as little space as possible within the device, which then allows devices to be smaller, or for the addition of more specific components and functionalities into the device. It is even more critical in the case in which the wireless device is a multifunctional wireless device, such as the ones described in patent applications U.S. 2014/0253395 and WO2008/009391. The entire disclosures of patent applications U.S. 2014/0253395 and WO2008/009391 are hereby incorporated by reference.

Besides radiofrequency performance, small size and reduced interaction with human body and nearby electronic components, one of the current limitations of the prior art is that generally the antenna system is customized for every particular wireless handheld device model. The mechanical architecture of each device is different and the volume available for the antenna severely depends on the form factor of the wireless device model together with the arrangement of the multiple components embedded into the device (e.g., displays, keyboards, battery, connectors, cameras, flashes, speakers, chipsets, memory devices, etc.). As a result, the antenna within the device is mostly designed ad hoc for every model, resulting in a higher cost and a delayed time to market. In turn, as typically the design and integration of an antenna element for a radiating structure is customized for each wireless device, different form factors or platforms, or a different distribution of the functional blocks of the device will force to redesign the antenna element and its integration inside the device almost from scratch.

A radiating system for a wireless handheld or portable device typically includes a radiating structure comprising an antenna element which operates in combination with a ground plane layer providing a determined radiofrequency performance in one or more frequency regions of the electromagnetic spectrum. Typically, the antenna element has a dimension close to an integer multiple of a quarter of the wavelength at a frequency of operation of the radiating structure, so that the antenna element is at resonance or substantially close to resonance at the frequency of operation, and a radiation mode is excited on the antenna element. Due to given space limitations in the device and the necessity of providing operation in two or more frequency bands that, in some cases, are located in at least two separate frequency regions of the electromagnetic spectrum, the antenna elements usually present complex mechanical designs and considerable dimensions, mainly due to the fact that antenna performance is highly related to the electrical dimensions of the antenna element. Although the radiating structure is usually very efficient at the resonant frequency of the antenna element and maintains a similar performance within a frequency range defined around the resonant frequency (or resonant frequencies), outside the frequency range the efficiency and other relevant antenna parameters deteriorate with an increasing distance to the resonant frequency.

Some techniques for miniaturizing and/or optimizing the multiband behavior of an antenna element have been described in the prior art. However, the radiating structures described therein still rely on exciting a radiation mode on the antenna element for each one of the frequency bands of operation.

Also, those prior-art multiband antennas usually feature a large and complex structure that quite often needs to be customized for every wireless device. For instance J. Ilvonen et al. "*Design Strategy for 4G Handset Antennas and a Multiband Hybrid Antennas*", IEEE Transactions APS, April 2014, discloses an antenna element which is still about 50×15 mm, a quite significant footprint for the current needs of modern smartphones.

In this sense, a radiating system such as the one described in the present disclosure not requiring a complex and/or large antenna formed by multiple arms, slots, apertures and/or openings and a complex mechanical design is preferable in order to minimize such undesired external effects and simplify the integration within the wireless device.

Some other attempts have focused on antenna elements not requiring a complex geometry while still providing some degree of miniaturization by using an antenna element not resonant in the one or more frequency ranges of operation of the wireless device.

For example, patent application WO2007/128340 discloses a wireless portable device comprising a non-resonant antenna element for receiving broadcast signals (such as, for instance, DVB-H, DMB, T-DMB or FM). The wireless portable device further comprises a ground plane layer that is used in combination with the antenna element. Although the antenna element has a first resonant frequency above the frequency range of operation of the wireless device, the antenna element is still the main responsible for the radiation process and for the radio-frequency performance of the wireless device. No radiation mode can be substantially excited on the ground plane layer because the ground plane layer is electrically short at the frequencies of operation (i.e., its dimensions are much smaller than the wavelength). For this kind of non-resonant antenna elements, a matching circuitry is added for matching the antenna to a level of SWR in a limited frequency range, which in this particular case can be around SWR≤6.

Commonly-owned patent application WO2008/119699 describes a wireless handheld or portable device comprising a radiating system capable of operating in two frequency regions. The radiating system comprises an antenna element having a resonant frequency outside the two frequency regions, and a ground plane layer. In this wireless device, while the ground plane layer contributes to enhance the electromagnetic performance of the radiating system in the two frequency regions of operation, it is still necessary to excite a radiation mode on the antenna element. In fact, the radiating system relies on the relationship between a resonant frequency of the antenna element and a resonant frequency of the ground plane layer for the radiating system to operate properly in the two frequency regions. Nevertheless, the solution still relies on an antenna element whose size is related to a resonant frequency that is outside of the two frequency regions.

In order to reduce the volume occupied in the wireless handheld or portable device as much as possible, recent trends in handset antenna design are oriented to maximize the contribution of the ground plane to the radiation process by using small non-resonant elements. However, non-resonant elements may require of complex radiofrequency systems. Thus, the challenge of these techniques mainly relies on the complexity (combination of inductors, capacitors, and transmission lines), which is required to satisfy impedance bandwidth and efficiency specifications.

Commonly owned patent applications WO2010/015365 and WO2010/015364 are intended for solving some of the aforementioned drawbacks. Namely, they describe a wireless handheld or portable device comprising a radiating system including a radiating structure and a radiofrequency system. The radiating structure is formed by a ground plane layer presenting suitable dimensions as for supporting at least one efficient radiation mode and at least one radiation booster capable of coupling electromagnetic energy to the ground plane layer. The radiation booster is not resonant in any of the frequency regions of operation and, consequently, a radiofrequency system is used to properly match the radiating structure to the desired frequency bands of operation. More specifically, in WO2010/015364 each radiation booster is intended for providing operation in a particular frequency region. Thus, the radiofrequency system is designed in such a way that the first internal port associated to a first radiation booster is highly isolated from the second internal port associated to a second radiation booster. The radiofrequency system usually comprises a matching network including resonators for each one of the frequency regions of operation and a set of filters for each one of the frequency regions of operation. Thus, the radiofrequency system requires multiple stages and the performance of the radiating systems in terms of efficiency may be affected by the additional losses of the components.

Commonly owned patent applications WO2014/012796 and U.S. 2014/0015730 disclose a concentrated wireless device comprising a radiating system including a radiating structure and a radiofrequency system, such device operates two or more frequency regions of the electromagnetic spectrum. A feature of the radiating system is that the operation in at least two frequency regions is achieved by one radiation booster, or by at least two radiation boosters, or by at least one radiation booster and at least one antenna element, wherein the radiofrequency system modifies the impedance of the radiating structure, providing impedance matching to the radiating system in the at least two frequency regions of operation of the radiating system.

In commonly owned patent application U.S. 2013/0342416 there is disclosed a radiating system that transmits and receives in first and second frequency regions and includes a radiating structure comprising radiation boosters, or a radiation booster and a radiating element, or radiating elements. The radiating system further includes a radiofrequency system including: first and second reactance cancellation elements providing impedances having an imaginary part close to zero for respective frequencies in the first and second frequency regions, and a delay element interconnecting the first and second reactance cancellation elements to provide a difference in phase to produce first and second impedance loops in the first and second frequency regions, respectively, at an external port. The difference in phase provides operation in at least two frequency bands, each one allocated in a different frequency region of the electromagnetic spectrum, and/or increases the number of operating frequency bands in at least one frequency region of the electromagnetic spectrum, and/or increases the number of operating frequency bands in at least two frequency regions of the electromagnetic spectrum.

Commonly owned patent applications WO2014/012842 and U.S. 2014/0015728 disclose very compact, small size and light weight radiation boosters operating in single or in multiple frequency bands. Such radiation boosters are configured to be used in radiating systems that may be embedded into a wireless handheld device. The patent applications further disclose radiation booster structures and their manufacturing methods that enable reducing the cost of both the booster and the entire wireless device embedding the booster inside the device. The entire disclosure of aforementioned application numbers WO2014/012842 and U.S. 2014/0015728 are hereby incorporated by reference.

Commonly owned patent applications U.S. 62/028,494 and EP14178369 disclose a wireless device including at least one slim radiating system having a slim radiating structure and a radio-frequency system. The slim radiating structure includes one or more booster bars. The booster bar is characterized by its slim width and height factors which facilitate its integration within the wireless device and the excitation of a resonant mode in the ground plane layer, and by its location factor that enables to achieve the most favorable radio-frequency performance for the available space to allocate the booster bar. The entire disclosure of aforementioned application numbers U.S. 62/028,494 and EP14178369 are hereby incorporated by reference.

Another technique, as disclosed in U.S. Pat. No. 7,274,340, is based on the use of two coupling elements. According to the description herein, quad-band operation (GSM 1800/1900 and GSM850/900 bands) is provided with two coupling elements: a low-band (LB) coupling element (for the GSM850/900 bands), and a high-band (HB) coupling element (for the GSM1800/1900 bands), where the impedance matching is provided through the addition of two matching circuits, one for the LB coupling element and another one for the HB coupling element. In spite of using non-resonant elements, the size of the element for the low band is significantly large, being 1/9.3 times the free-space wavelength of the lowest frequency for the low frequency band. Due to such size, the low band element would be a resonant element at the high band. Additionally, the operation of this solution is closely linked to the alignment of the maximum E-field intensity of the ground plane and the coupling element. The size of the low band element undesirably contributes to increase the printed circuit board (PCB) space required by the antenna module.

There are already in the market some off-the-shelf antenna booster solutions that cover each cellular band in a wireless device within the 824-2690 MHz frequency range. For instance, Fractus Antennas S. L. offers a solution based in its mXTEND FR01-S4-224 booster product (hereinafter de FA224 booster) as described in its application note (http://www.fractusantennas.com/wp-content/uploads/2016/07/AN_FR01-S4-224_Junior-All-in-One.pdf), available at www.fractusantennas.com. Despite being a compact, off-the-shelf solution, this arrangement still not covers the LTE700 band and below, through a single booster. Covering such a frequency band is difficult as such a low wavelength is long in terms of the size of a typical wireless platform such as a smartphone, and therefore the inherent bandwidth achievable at those frequencies is usually small. Furthermore, this is particularly challenging when one considers the full cellular range from 698 MHz (at the lower edge of LTE700) up to 960 MHz (at the upper edge of GSM900), which features a bandwidth relative to the central frequency above a 30%. Such a broad bandwidth implies a low Q, which a skilled in the art knows it is usually in contradiction with using a small antenna element.

However, making a large antenna element does not necessarily deliver a suitable solution either. When the element is made large to resonate in the low frequency region (698-960 MHz), quite often a high impedance radiation mode is placed within the high frequency region (e.g. 1710-2690 MHz). This high impedance mode is difficult to match, so solving the problem for the low region (to the expense of enlarging the antenna element) makes actually worse the fit in the high frequency region.

In addition, the above available solution based on the FA224 booster includes a significant clearance area around the component, which makes the integration in a highly populated electronic device cumbersome.

There are other booster based solutions available in the market that cover the entire range of cellular bands (e.g. at least from 698 MHz to 2690 MHz), but those require the use of multiple antenna boosters (see for instance the User Manual of the booster FR01-54-250, "CUBE mXTEND™ (FR01-S4-250)—A standard antenna solution for mobile frequency bands" available at www.fractusantennas.com).

Therefore, a wireless device not requiring a large and complex antenna element yet providing suitable radio-frequency performance to operate in a wide range of communication bands within multiple regions of the electromagnetic spectrum including the low LTE bands and below, would be advantageous as it would ease the integration of the radiating structure into the wireless handheld or portable device. The volume freed up by the absence of a large and complex antenna element would enable smaller and/or thinner devices, as slim electronic devices, or even to adopt radically new form factors which are not feasible today due to the presence of an antenna element featured by a considerable volume.

SUMMARY

It is an object to provide a wireless electronic device (such as for instance but not limited to a mobile phone, a smartphone, a phablet, a tablet, a PDA, an MP3 player, a headset, a USB dongle, a GPS system, a laptop computer, a gaming device, a digital camera, a wearable device as a smart watch, a PCMCIA, Cardbus 32 card, a sensor, or generally a multifunction wireless device which combines the functionality of multiple devices) comprising a radiating system that covers a wide range of radio frequencies and handles multiple communication bands while exhibiting a suitable radio frequency performance. In particular, it is the aim to provide a wireless device and an antenna component that delivers the whole antenna functionality throughout a wide range of mobile frequencies through an external port. Usually, the wireless device would include LTE700 bands and/or below in its operation frequencies range.

In general, a described embodiment relates to a wireless handheld or portable device comprising a radiating system configured to transmit/receive electromagnetic wave signals at least at a first frequency region and a second frequency region, wherein the lowest frequency of the second frequency region is above the highest frequency of the first frequency region. The radiating system comprises a radiating structure, a radiofrequency system and an external port, the radiating structure comprising: at least a ground plane layer etched on a printed circuit board; a first antenna element connected to a feeding line, advantageously being in some embodiments a single antenna element, wherein each antenna element fits in an imaginary sphere having a diameter smaller than ½ of a radian-sphere having a radius equal to a free-space wavelength corresponding to the lowest frequency of a first frequency region, divided by two times π (pi); a first internal port defined between a connection point of the antenna element and a first connection point of the ground plane layer. The radiofrequency system comprises a first matching network, which is normally connected to the first feeding line, the matching network used for matching all the target frequency bands, even if comprised in different regions, the first matching network comprising at least a first electrically reactive element.

In some embodiments, a radiating structure comprised in the radiating system comprises more than one ground plane layer, like for instance two, three or even more ground plane layers or conductive material layers acting as the ground plane for the radiating structure. In such embodiments, some or all ground plane layers are electrically interconnected one to each other.

The described antenna element features a maximum length smaller than L/3, yet preferably smaller than L/10 and even L/12 or L/20, being L the free-space wavelength corresponding to a lowest frequency related to a lowest frequency region of operation, the maximum length being bigger than L/22. A maximum length is defined as the largest edge of the minimum parallelepiped box enclosing the element. In some embodiments the maximum length is within the 20-40 mm range, yet preferably within the 22-35 mm or even 22-30 mm range. In some embodiments, such a maximum length will be around 25 mm.

The described antenna element or component includes one or more conductive layers. In some embodiments, all the conductive layers feature a convex shape. Quite advantageously, the contour shape of the conductive layers is rather simple while the same antenna component might be reused in multiple wireless platforms without any need for customization. The level of complexity of an antenna element can be advantageously parameterized by two complexity factors, hereinafter referred to as F21 and F32, which capture the geometrical details of the antenna element (such as for instance its edge-richness, angle-richness and/or discontinuity-richness) when looked at different levels of scale.

As described in patent U.S. Pat. No. 9,130,267 B2, for the computation of F21 and F32, a first, a second, and a third grid (hereinafter called grid G1, grid G2 and grid G3 respectively) of substantially square or rectangular cells are placed on the antenna rectangle. The three grids are adaptive to the antenna rectangle. That is, the size and aspect ratio of the cells of each one of the three grids is determined by the size and aspect ratio of the antenna rectangle. The use of adaptive grids is advantageous because it provides sufficient number of cells within the antenna rectangle to fully capture the geometrical features of the antenna contour.

Moreover, the three grids are selected to span a range of levels of scale corresponding to two octaves: A side of a cell of grid G2 is half the size of a side of a cell of grid G1 (i.e., a ½ scaling factor or an octave of scale); a side of a cell of grid G3 is half the size of a side of a cell of grid G2, or one fourth the size of a side of a cell of grid G1 (i.e., a ¼ scaling factor of two octaves of scale). A range of scales of two octaves provides a sufficient variation in the size of the cells across the three grids as to capture gradually from the coarser features of the antenna contour to the finer ones.

Grids G1 and G3 are constructed from grid G2, which needs to be defined in the first place.

As far as the second grid (or grid G2) is concerned, the size of a cell and its aspect ratio (i.e., the ratio between the width and the height of the cell) are chosen so that the antenna rectangle is perfectly tessellated with an odd number of columns and an odd number of rows.

In the present document, columns of cells are associated to the long side of an antenna rectangle, while rows of cells are associated to a short side of the antenna rectangle. In other words, a long side of the antenna rectangle spans a number of columns, being the columns parallel to the short side of the antenna rectangle. In the same way a short side of the antenna rectangle spans a number of rows, being the rows parallel to the long side of the antenna rectangle.

If the antenna rectangle is tessellated with an excessive number of columns, then the size of the resulting cells is much smaller than the range of typical sizes of the features necessary to shape the antenna contour. However, if the antenna rectangle is tessellated with an insufficient number of columns, then the size of the resulting cells is much larger than the range of typical sizes of the features necessary to shape the antenna contour. It has been found that setting to nine (9) the number of columns that tessellate the antenna rectangle provides an advantageous compromise, for the preferred sizes of a wireless handheld or portable device, and the corresponding available volumes for the antenna structure. Therefore, a cell width (W2) is selected to be equal to a ninth (⅑) of the length of the long side of the antenna rectangle (W).

Moreover, it is also advantageous to use cells that have an aspect ratio closest to one. In other words, the number of columns and rows of cells of the second grid that tessellate the antenna rectangle are selected to produce a cell as square as possible. A grid formed by cells having an aspect ratio close to one is preferred in order to perceive features of the antenna contour using approximately a same level of scale along two orthogonal directions defined by the long side and the short side of the antenna rectangle. Therefore, preferably, the cell height (H2) is obtained by dividing the length of the short side of the antenna rectangle (H) by the odd integer number larger than one (1) and smaller than, or equal to, nine (9), that results in an aspect ratio W2/H2 closest to one.

In the particular case that two different combinations of a number of columns and rows of cells of the second grid produce a cell as square as possible, a second grid is selected such that the aspect ratio is larger than 1.

In some examples, an antenna contour may comprise a portion (such as for instance a part of an arm) in which the separation between two non-adjacent edges is smaller than the cell width W2. In those examples, the portion of the antenna contour does not substantially distinguish from a zero-width line, and the segments of the antenna contour associated to the portion should be replaced by a line placed at the middle distance from the two non-adjacent edges (i.e., each point of the line is placed at equal distance from a point of each of the two non-adjacent edges). As a consequence of this modification, the antenna contour may, in some cases, require the resizing of the antenna rectangle and/or the recalculation of the grids.

Thus, the antenna rectangle is tessellated perfectly with 9 by (2n+1) cells of grid G2, wherein n is an integer larger than zero (0) and smaller than five (5). A first grid (or grid G1) is obtained by combining four (4) cells of the grid G2. Each cell of the grid G1 consists of a 2-by-2 arrangement of cells of grid G2. Therefore, a cell of the grid G1 has a cell width equal to twice (2) the width of a cell of the second grid (W2) (i.e., $W1=2\times W2$); and a cell height (H1) equal to twice (2) the height of a cell of the second grid (H2) (i.e., $H1=2\times H2$).

Since grid G2 tessellates perfectly the antenna rectangle with an odd number of columns and an odd number of rows, an additional row and an additional column of cells of the grid G2 are necessary to have enough cells of the grid G1 as to completely cover the antenna rectangle.

In order to define uniquely the tessellation of the antenna rectangle with grid G1 a corner of the antenna rectangle is selected to start placing the cells of the grid G1.

A feeding point corner is defined as being the corner of the antenna rectangle closest to a connection point of the radiating element used for feeding purposes and responsible for the operation of the radiating element in its lowest frequency region. In case that the connection point is placed at an equal distance from more than one corner of the antenna box, then the corner closest to a perimeter of the ground plane layer of the antenna structure is selected, preferably the corner closest to a shorter edge of the ground plane rectangle. In case both corners are placed at the same distance from the connection point and from the shorter edge of the ground plane rectangle, the feeding point corner will be chosen, then owing to ergonomics reasons and taking into account the absorption of radiation in the hand of the user of a wireless handheld or portable device, and considering that there is a predominance on right-handed users, it has been observed that in some embodiments it is convenient to place a connection point for feeding purposes and/or to designate the feeding point corner on the corner of the antenna rectangle which is closer to a left corner of the ground plane rectangle, being the left side of the ground plane rectangle the closest to the left side of the wireless handheld or portable device as seen by a right handed user holding typically the device with her right hand to originate a phone call, while facing a display of the device. Also, the selection of the feeding point corner on the top or bottom corner on the left side of the wireless handheld or portable device depends on the position of the radiating element with respect to a body of the wireless handheld or portable device: an upper-left corner of the antenna rectangle is preferred in those cases in which the radiating element is placed substantially near the top part of the body of the wireless handheld or portable device (usually, above and/or behind a display); and a lower-left corner of the antenna rectangle is preferred in those cases in which the radiating element is placed substantially near the bottom part of the body of the wireless handheld or portable device (usually, below and/or behind a keypad). Again, due to ergonomics reasons, a top and a bottom part of a body of a wireless handheld or portable device are defined as seen by a right handed user holding typically the device with her right hand to originate a phone call, as also described in patent U.S. Pat. No. 9,130,267 B2.

A first cell of the grid G1 is then created by grouping four (4) cells of grid G2 in such a manner that:

a corner of the first cell is the feeding point corner, and the first cell is positioned completely inside the antenna rectangle.

Once the first cell of the grid G1 is placed, other cells of the grid G1 can be placed defining uniquely the relative position of the grid G1 with respect to the antenna rectangle. The antenna rectangle spans 5 by (n+1) cells of the grid G1, (when G2 includes 9 columns) requiring the additional row and the additional column of cells of the grid G2 that meet at the corner of the antenna rectangle that is opposite to the feeding point corner, and that are not included in the antenna rectangle.

The complexity factor F21 is computed by counting the number of cells N1 of the grid G1 that are at least partially inside the antenna rectangle and include at least a point of the antenna contour (as described herein, the boundary of the cell is also part of the cell), and the number of cells N2 of the grid G2 that are completely inside the antenna rectangle and include at least a point of the antenna contour, and applying then the following formula: $F21=-(\log(N2)-\log(N1))/\log(½)$. Complexity factor F21 is predominantly aimed at capturing the complexity and degree of convolution of features of the antenna contour that appear when the contour is looked at coarser levels of scale.

A third grid (or grid G3) is readily obtained by subdividing each cell of grid G2 into four cells, having each of the cells a cell width (W3) equal to one half (½) of the width of a cell of the second grid (W2) (i.e., $W3=½\times W2$); and a cell height (H3) equal to one half (½) of the height of a cell of the second grid (H2) (i.e., $H3=½\times H2$). Therefore, since each cell of the grid G2 is replaced with 2-by-2 cells of the grid G3, then 18 by (4n+2) cells of grid G3 are thus required to tessellate completely the antenna rectangle.

The complexity factor F32 is computed by counting the number of cells N2 of grid G2 that are completely inside the antenna rectangle and include at least a point of the antenna contour, and the number of cells N3 of the grid G3 that are completely inside the antenna rectangle and include at least a point of the antenna contour, and applying then the following formula: $F32=-(\log(N3)-\log(N2))/\log(½)$. Complexity factor F32 is predominantly directed at capturing the complexity and degree of convolution of features of the antenna contour that appear when the contour is looked at finer levels of scale.

In some embodiments, such contour shape features a low complexity factor, for instance a complexity factor F12 below 1.5 or even below 1.3 or 1.25, preferably smaller than 1.15 or even 1.1, in some embodiments combined with a F32 below 1.5 as well. Such low complexity factors (either F21, F32 or both) are still larger than 1.

In an embodiment, an antenna element with a low complexity factor as described above is advantageously placed on a ground clearance of the printed circuit board (PCB) within the wireless device. Such a clearance is an area on the PCB characterized by an absence of any grounded conducting surface underneath or above the antenna element and its immediate surroundings. Normally, such an antenna element is combined with a conductive trace, normally metallic, on the clearance area comprised in the PCB. Such a trace connects the antenna element to the ground plane layer comprised in the radiating structure. Quite preferably, such a trace follows a path near an edge and eventually around a corner of the PCB. In some embodiments, the combined contour of the metal trace together with the antenna element also features a low complexity factor, for instance a complexity factor F12 below 1.5 or even below 1.3 or 1.25, in some embodiments combined with a F32 below 1.5 as well. In other embodiments, the contour of the antenna element is rectangular or nearly rectangular.

As mentioned before, an antenna element features at least a conductive element with a low complexity shape, the shape including in some examples a first large convex area adjacent to a second smaller convex area. In some of those embodiments, such first and second convex elements are rectangular elements.

A wireless device features an antenna element arranged nearby the corner of a wireless device and/or nearby a corner of a PCB within the device. A first edge of the contour of the antenna element is aligned with an edge of the PCB, and a second edge opposite to the first edge is aligned to an edge of a ground layer on the PCB, so that a clearance area underneath the antenna component fits within the first and second edge of the antenna elements.

A radiating system is configured to transmit and receive signals in frequency bands like for example, but not limited to: LTE700 (698-746 MHz), LTE800 (791-862 MHz), GSM850 (824-894 MHz), GSM900 (880-960 MHz), GSM1800 (1710-1880 MHz), GSM1900 (1850-1990 MHz), WCDMA2100 (1920-2170 MHz), CDMA1700 (1710-2155 MHz), LTE2300 (2300-2400 MHz), LTE2600 (2500-2690 MHz), LTE3500 (3.4-3.6 GHz), LTE3700 (3.6-3.8 GHz), WiFi (2.4-2.5 GHz and/or 4.9-5-5.9 GHz), etc. Such radiating systems may operate five, six, seven, eight, nine, ten or even more frequency bands.

In the context of this document, a frequency band preferably refers to a range of frequencies used by a particular cellular communication standard, a wireless connectivity standard or a broadcast standard; while a frequency region preferably refers to a continuum of frequencies of the electromagnetic spectrum. For example, the GSM1800 standard is allocated in a frequency band from 1710 MHz to 1880 MHz while the GSM1900 standard is allocated in a frequency band from 1850 MHz to 1990 MHz. A wireless device operating the GSM1800 and the GSM1900 standards must have a radiating system capable of operating in a frequency region from 1710 MHz to 1990 MHz. As another example, a wireless device operating the GSM850 standard (allocated in a frequency band from 824 MHz to 894 MHz) and the GSM1800 standard must have a radiating system capable of operating in two separate frequency regions.

In some embodiments, a ratio between the lowest frequency of the second frequency region and the lowest frequency of the first frequency region is greater than 1.5. In some other embodiments, the ratio may be greater than 1.8, or 2.0, or 2.2, or even greater than 2.4. In some of these embodiments, a ratio between the lowest frequency of the second frequency region and the highest frequency of the first frequency region may be greater than 1.2, or 1.5, or 1.8, or 2.0, or 2.2, or even greater than 2.4.

Moreover, a radiating system advantageously features an impedance bandwidth in the first frequency region larger than 5%, or 10%, or 15%, or even larger than 20%. In addition, such radiating system also normally features an impedance bandwidth in the second frequency region larger than 5%, or 10%, or 15%, or 20%, or 25%, or 30%, or 35%, or even larger than 40%. The impedance bandwidth is defined as the difference between the highest and lowest frequencies of a frequency region, divided by the central frequency of that frequency region.

A radiating structure, when disconnected from the radiofrequency system, normally features at one, some or all of the internal ports a first resonant frequency at a frequency higher than the highest frequency of the first frequency region. The input impedance of the radiating structure measured at the internal port/s (in absence of a radiofrequency system connected to it) features in some examples an important reactance within the frequencies of the first frequency region. A ratio between the first resonant frequency of the radiating structure measured at the internal port/s (when disconnected from the radiofrequency system) and the highest frequency of the first frequency region is advantageously greater than 1.1. In some cases, the ratio is even greater than 1.5, 1.8, 2.0, 2.2, 2.4, 2.6, 2.8, or 3.0. In some examples, a ratio between the first resonant frequency of the radiating structure measured at the internal port/s (in absence of a radiofrequency system connected to it) and the lowest frequency of the first frequency region is advantageously greater than 1.3, or even greater than 1.4, 1.5, 1.8, 2.0, 2.2, 2.4, 2.6, 2.8, or 3.0.

In some embodiments, the first resonant frequency of the radiating structure, measured at its internal port when disconnected from the radiofrequency system, is above the highest frequency of the second frequency region, wherein a ratio between the first resonant frequency and the highest frequency of the second frequency region is larger than 1.0, 1.1, 1.2, 1.4, 1.6, 1.8, or 2.0. In some other embodiments, the first resonant frequency is within the second frequency region. In some other examples, the first resonant frequency is above the highest frequency of the first frequency region and below the lowest frequency of the second frequency region.

In some embodiments, the first resonant frequency of the radiating structure, measured at its internal port when disconnected from the radiofrequency system, is advantageously placed around 1.5 GHz. Preferably, such a resonant frequency is typically placed within the 1200-1650 MHz frequency range, yet more preferably within 1300-1600 MHz or even within 1400-1500 MHz range.

In the context of this document, a resonant frequency associated to an internal port of the radiating structure preferably refers to a frequency at which the input impedance of the radiating structure, the impedance being measured at the internal port, when disconnected from the radiofrequency system, has an imaginary part equal, or substantially equal, to zero. Also, the imaginary part of an impedance is considered, in the context of the described system, to be substantially close to zero if it is not larger (in absolute value) than 15 Ohms, and preferably not larger than 10 Ohms, and more preferably not larger than 5 Ohms.

A radiofrequency system comprises one or more matching circuits with one, two, three, four, or more stages each, with each stage comprising one or more circuit components (such as for example, but not limited to, inductors, capacitors, jumpers, short-circuits, transmission lines, or other reactive components). In some embodiments, a stage is advantageously connected in series or in parallel to other stages and/or to one of the at least one port of the radiofrequency system. In some examples, the matching network or networks comprised in the radiofrequency system alternate stages connected in series (i.e., cascaded) with stages connected in parallel (i.e. shunted), forming a ladder structure, or an L-shaped structure (i.e., series-parallel or parallel-series), or a pi-shaped structure (i.e., parallel-series-parallel) or a T-shaped structure (i.e., series-parallel-series). In some embodiments, a stage also behaves as a resonant circuit (such as, for instance, a parallel LC resonant circuit or a series LC resonant circuit) in at least one frequency region of operation of the radiating system (such as for instance in the first or second frequency region). Some matching circuits comprise three, four, five or six components.

Some of the benefits of an antenna element are as follows: firstly, being small and planar, the element can be produced as an off-the-shelf component that fits a wide range of wireless products without any need for customization. An off-the-shelf component enables benefiting from economies of scales, so that the cost of the product is potentially smaller in large productions of the final wireless device. Secondly, being small and planar, the antenna element can be arranged as a surface-mount-device, which can be automatically assembled in production on a PCB with a pick-and-place machine, which greatly reduces the manual operation, which is traditionally more complex in customized antennas.

In addition, these benefits related to the antenna element have their counterpart on a wireless device. The minimum clearance around the antenna element enables including more components inside the wireless device (e.g. speakers, connectors, memory cards, buttons, etc.) and so, more features. The off-the-shelf nature of the antenna component is translated in a faster assembly and design of the whole wireless device, therefore reducing its time-to-market. And the small size and profile of the antenna element enables slimmer, more compact devices, which are key aspects on the market acceptance of wireless devices such as for instance smartphones, tablets and other handheld wireless devices more in general.

BRIEF DESCRIPTION OF THE DRAWINGS

Further characteristics and advantages of the described system become apparent in view of the detailed description which follows with some examples given for purposes of illustration only and in no way meant as a definition of the limits of the system, referenced by the accompanying drawings.

DETAILED DESCRIPTION

Figure 1:
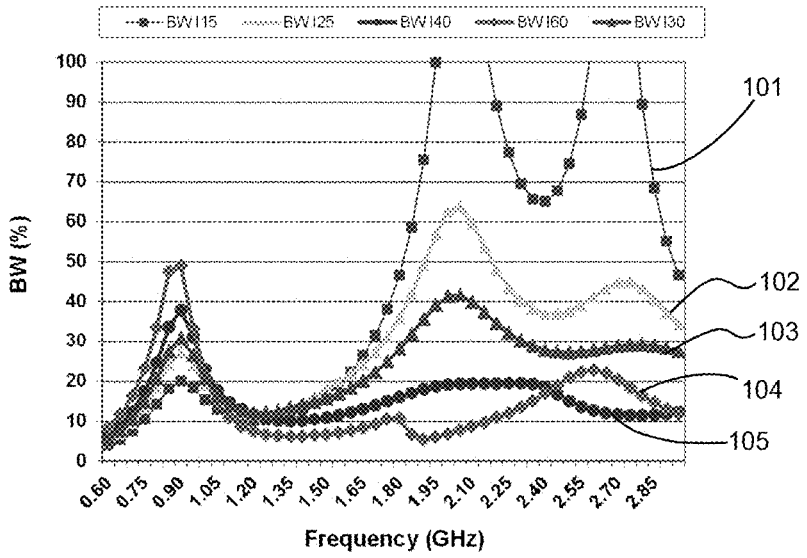
FIG. 1 discloses the achievable bandwidth of an embodiment comprising a rectangular antenna element as a function of its maximum length.
Figure 2:
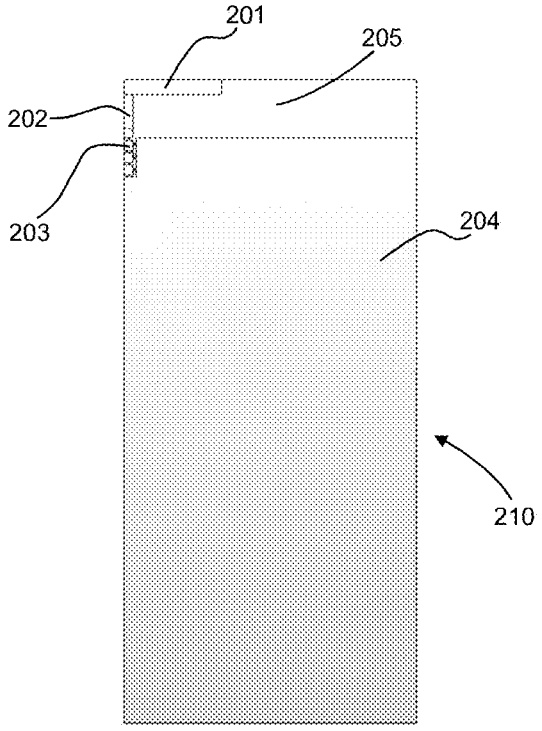
FIG. 2 a wireless device comprising a rectangular antenna element (horizontal), connected to a conductive trace and to a matching network.

FIG. 1 displays the achievable bandwidth for 5 different cases of antenna element. Such antenna element is a rectangular element such as for instance element (201) comprised in the embodiment provided in FIG. 2. The achievable bandwidth is displayed for 5 different maximum lengths of the antenna element: 15 mm (101), 25 mm (102), 30 mm (103), 40 mm (105) and 60 mm (104). As seen there, the greater the length, the better the element can be matched in the challenging low frequency region (698-960 MHz). However, beyond a certain point, the improvement achieved in the low frequency region does not compensate for the degradation in bandwidth in the high frequency region. It has been found that a suitable range of maximum lengths for an antenna element like the one comprised in an embodiment as shown in FIG. 2 is within the 20-40 mm range, yet preferably within the 22-35 mm or even 22-30 mm range. In some embodiments, such a maximum length will be around 25 mm.

An example of a wireless device is shown in embodiment 210, FIG. 2. The embodiment comprises an antenna element that includes a rectangular conductive element (201) substantially aligned with an edge of the PCB. A conducting trace (202) interconnects the rectangular element with a radiofrequency system including a matching network (203). The radiating system further includes a ground plane (204) which is typically printed on a layer of a printed circuit board (PCB). Underneath and surrounding the antenna element and conducting trace, there is a clearance area (205) without ground plane.

Figure 3:
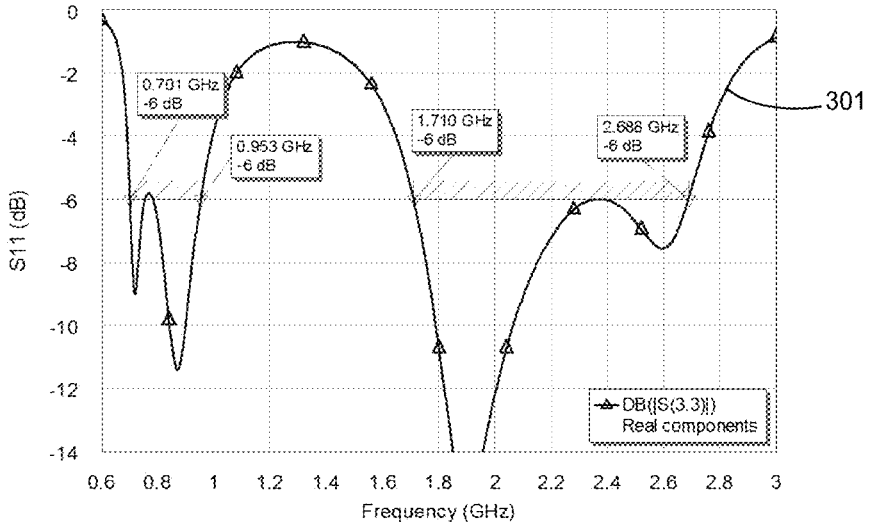
FIG. 3 return-loss corresponding to the embodiment provided in FIG. 2. The radiating system is matched below −6 dB within the nearly entire 698-960 MHz and 1710-2690 MHz frequency ranges.

As shown in FIG. 3, the radiating system in FIG. 2 is well matched in the desired frequency bands. Featuring a return loss below −6 dB within nearly the whole 698-960 MHz and 1710-2690 MHz frequency bands (curve 301), a single antenna component with a single port such as the specific case provided in FIG. 2 is able to cover the entire frequency range of cellular bands in a state of the art smartphone.

Figure 4:
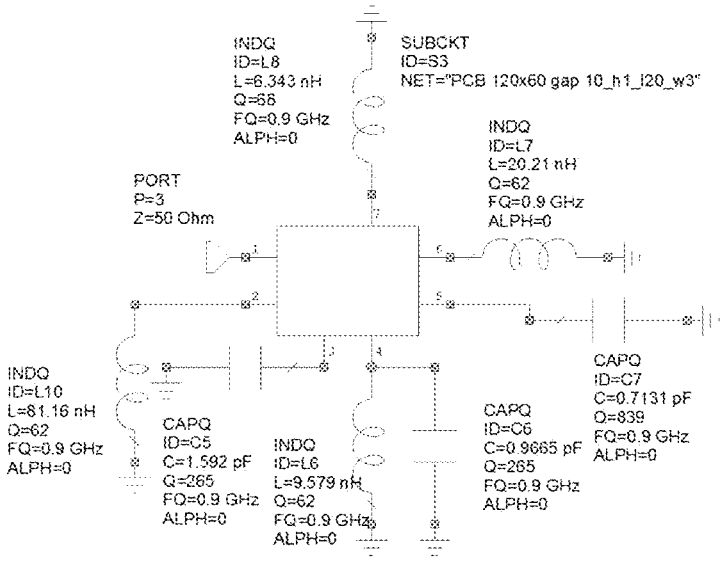
FIG. 4 matching network for the radiofrequency system used for matching an embodiment like the one shown in FIG. 2.

FIG. 4 shows an example of a matching network suitable for the embodiment in FIG. 2. In this particular example, the matching network includes a combination of more than 3 circuit elements including inductors and capacitors. In particular, this example features 7 elements including four inductors and three capacitors.

Figure 5:
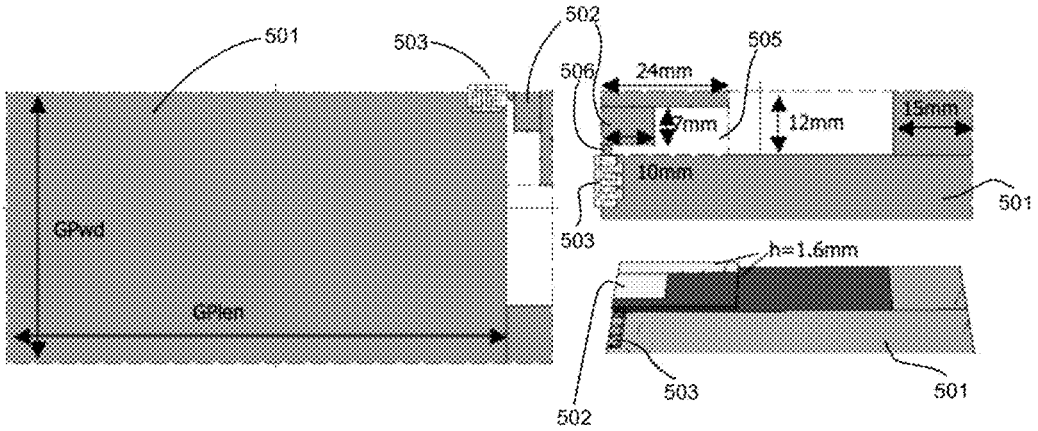
FIG. 5 a wireless device featuring an antenna element with a maximum size of 24 mm and two conducting layers with rectangular shape.

Another embodiment is shown in FIG. 5. A wireless device comprises a ground plane layer on a PCB (501). In this particular case, the dimensions of the ground plane are 130×60 mm2, which is a typical size for a smartphone wireless device. An antenna element (502) is arranged on a corner of a wireless device, and more concretely nearby a corner of the ground plane, with a longer edge on the element being aligned or substantially aligned with and edge of the PCB. The maximum length of the conducting surface of this particular antenna element is 24 mm. The conductive surface comprises two connected convex elements, a first nearly squared, rectangular element, and a second longer rectangular element. The conductive surface is printed on a dielectric support, such as for instance an FR4, Rogers®, or ceramic substrate. Both top and bottom sides of the conductive surface are connected between them by some connector such as for instance one, two or more vias. In some particular examples, the conductive surface is constructed with two sandwiched dielectric layers with top and bottom sides also interconnected by vias. An embodiment of the characteristics of the example provided in FIG. 5 features an input return loss below −6 dB in the whole 698-960 MHz and 1710-2690 MHz frequency bands.

Figure 6:
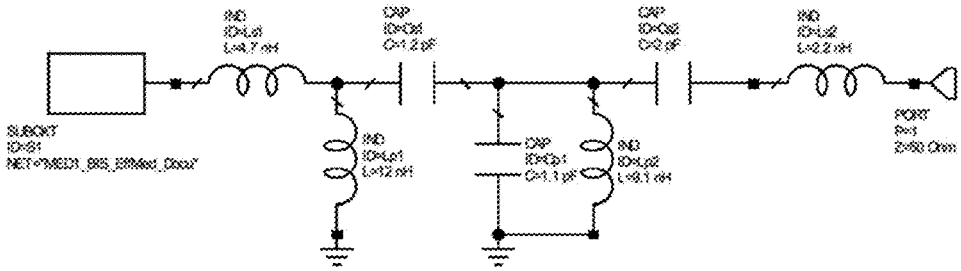
FIG. 6 matching network for the radiofrequency system used for matching an embodiment like the one shown in FIG. 2.

In this particular embodiment, the ground plane is extended on one side up to the edge of the PCB where the antenna element is aligned, so that the overall clearance area (505) is smaller compared to the one (205) included in the embodiment shown in FIG. 2. A matching network (503) is connected to a trace (506) which is connected to the nearly squared element comprised in the antenna element (502). A detail of a suitable matching network for this embodiment is shown for instance in FIG. 6. The matching network features more than 3 components, and in particular, 7 components, including a first series inductor connected to the element (502).

What is claimed is:

1. A wireless device comprising a radiating system that covers multiple frequency bands allocated in at least a first frequency region and a second frequency region, the radiating system comprising:

a radiofrequency system comprising at least a matching network that provides impedance matching to the radiating system at the multiple frequency bands; and a radiating structure comprising:

an antenna element capable of transmitting and receiving signals in the multiple frequency bands and connected to a feeding line through the radiofrequency system; and at least a ground plane layer, wherein a maximum length of the antenna element is shorter than L/12 but longer than L/22, where L is the free-space wavelength corresponding to a lowest frequency related to a lowest frequency region of operation.

2. The wireless device of claim 1, wherein the antenna element features a maximum length within the 22 mm to 30 mm range, the wireless device operating at a first low-frequency region ranging from 698 MHz to 960 MHz.

3. The wireless device of claim 1, wherein a ratio between the lowest frequency of the second frequency region and the highest frequency of the first frequency region is greater than 1.2.

4. The wireless device of claim 1, wherein the antenna element includes one or more conductive layers featuring a simple contour shape characterized by a complexity factor $F_{12}$ below 1.25.

5. The wireless device of claim 4, wherein the contour features a rectangular shape.

6. The wireless device of claim 4, wherein the antenna element includes a first large convex area adjacent to a second smaller convex area.

7. The wireless device of claim 4, wherein the antenna element is placed on a ground clearance contained in the ground plane layer, the antenna element being combined with a conductive trace that connects it to the ground plane layer.

8. The wireless device of claim 7, wherein a combined contour of the conductive trace together with the antenna element features a low complexity factor $F_{12}$ below 1.25.

9. The wireless device of claim 1, wherein the radiating system comprises two or more ground plane layers.

10. The wireless device of claim 9, wherein the ground plane layers are electrically interconnected one to each other.

11. The wireless device of claim 1, wherein the radiofrequency system comprises a matching network that includes a plurality of stages comprising one or more circuit components, the stages being connected in series or in parallel with each other.

12. The wireless device of claim 1, wherein:

the radiating structure, when disconnected from the radiofrequency system, features a first resonance frequency at a frequency higher than the highest frequency of the first frequency region, measured between the antenna element and the ground plane layer; and a ratio between the first resonance frequency and a highest frequency of the first frequency region is greater than 1.5.

13. The wireless device of claim 1, wherein:

the radiating structure, when disconnected from the radiofrequency system, features a first resonance frequency at a frequency higher than the highest frequency of the first frequency region, measured between the antenna element and the ground plane layer; and a ratio between the first resonance frequency and a lowest frequency of the first frequency region is greater than 1.8.

14. The wireless device of claim 1, wherein:

the radiating structure, when disconnected from the radiofrequency system, features a first resonance frequency at a frequency higher than the highest frequency of the second frequency region, measured between the antenna element and the ground plane layer; and a ratio between the first resonance frequency and the highest frequency of the second frequency region is greater than 1.1.

15. The wireless device of claim 1, wherein the radiating structure features a first resonance frequency placed within the 1200 MHz-1650 MHz frequency range, measured between the antenna element and the ground plane layer when the radiating structure is disconnected from the radiofrequency system.

16. The wireless device of claim 1, wherein the radiating system features an impedance bandwidth in the first frequency region greater than 20% and in the second frequency region greater than 40%.

* * * * *